US008136631B2

(12) United States Patent
Ashmus

(10) Patent No.: US 8,136,631 B2
(45) Date of Patent: Mar. 20, 2012

(54) BUILDING ESCAPE SYSTEM

(76) Inventor: James L. Ashmus, Kenosha, WI (US)

( * ) Notice: Subject to any disclaimer, the term of this patent is extended or adjusted under 35 U.S.C. 154(b) by 0 days.

(21) Appl. No.: 12/238,677

(22) Filed: Sep. 26, 2008

(65) Prior Publication Data

US 2009/0014241 A1 Jan. 15, 2009

Related U.S. Application Data

(63) Continuation-in-part of application No. 11/207,445, filed on Aug. 19, 2005, now abandoned, and a continuation of application No. 12/036,133, filed on Feb. 22, 2008, now abandoned.

(60) Provisional application No. 60/902,687, filed on Feb. 22, 2007.

(51) Int. Cl.
*E06C 1/56* (2006.01)

(52) U.S. Cl. ..... 182/42; 182/196

(58) Field of Classification Search ..... 182/42, 182/196

See application file for complete search history.

(56) References Cited

U.S. PATENT DOCUMENTS

| | | | |
|---|---|---|---|
| 242,716 | A | 6/1881 | Thompson |
| 255,379 | A | 3/1882 | Darby |
| 256,874 | A | 4/1882 | Borgfeldt |
| 266,183 | A | 10/1882 | Moore |
| 276,969 | A | 5/1883 | Hitchcock |
| 285,832 | A | 10/1883 | Murphy |
| 294,360 | A | 3/1884 | Borgfeldt |
| 308,334 | A | 11/1884 | Wright |
| 309,545 | A | 12/1884 | Hirt |
| 323,092 | A | 7/1885 | Werner |
| 331,081 | A | 11/1885 | Neumeyer |
| 333,182 | A | 12/1885 | Wetmore |
| 369,681 | A | 9/1887 | Bemish |
| 412,630 | A | 10/1889 | Klipp |
| 433,061 | A | 7/1890 | Aarons |
| 455,232 | A | 6/1891 | Mullennex |
| 471,145 | A | 3/1892 | Schneider |
| 475,175 | A | 5/1892 | Bidwell |
| 483,463 | A | 9/1892 | Lynch, Jr. |
| 560,713 | A | 5/1896 | Herrmann |
| 641,121 | A | 1/1900 | Knight |
| 648,327 | A | 4/1900 | Ames et al. |
| 686,182 | A | 11/1901 | Wright |
| 708,846 | A | 9/1902 | Vieregg |

(Continued)

FOREIGN PATENT DOCUMENTS

| | | |
|---|---|---|
| FR | 2 686 024 | 1/1992 |

(Continued)

*Primary Examiner* — Alvin Chin Shue

(74) *Attorney, Agent, or Firm* — Jansson Shupe & Munger Ltd.

(57) ABSTRACT

An escape system for a building, including a belting ladder formed by an endless band of a flat flexible reinforced belting material with a plurality of longitudinally-spaced apertures each with a substantially transverse edge portion forming rung-like features therealong for human engagement, and a control apparatus having (a) a support structure mountable to the building, the support structure having a central shaft and a rotatable pulley member secured thereto with the endless band therearound, (b) a speed limiter mounted with respect to the main shaft for restraining rotation of the pulley member during human descent by belt movement. In some embodiments, the control apparatus also includes a winder device adjacent to the pulley member and having at least one winder rod engageable with the belt and orbitable with an engaged portion thereof about the pulley member.

17 Claims, 8 Drawing Sheets

U.S. PATENT DOCUMENTS

| | | | | | |
|---|---|---|---|---|---|
| 709,127 | A | | 9/1902 | Wachter | |
| 716,109 | A | | 12/1902 | Rodde | |
| 819,956 | A | | 5/1906 | Thomsen | |
| 841,265 | A | | 1/1907 | Noonan | |
| 361,707 | A | | 7/1907 | Cain | |
| 869,151 | A | | 10/1907 | Zube | |
| 892,281 | A | | 6/1908 | Metter | |
| 924,695 | A | | 6/1909 | Sheeley | |
| 1,069,325 | A | * | 8/1913 | Elsner | 182/43 |
| 1,076,646 | A | | 10/1913 | Scheiden | |
| 1,123,029 | A | | 12/1914 | Smith | |
| 1,176,607 | A | * | 3/1916 | Schoonover | 182/44 |
| 1,181,667 | A | | 5/1916 | Jaffie | |
| 1,191,504 | A | * | 7/1916 | Gray | 182/42 |
| 1,370,306 | A | | 3/1921 | Griest | |
| 1,683,138 | A | | 9/1928 | Kautz | |
| 1,753,798 | A | | 4/1930 | Martin | |
| 1,914,889 | A | | 6/1933 | Lugara | |
| 2,607,523 | A | | 8/1952 | Williams et al. | |
| 3,385,399 | A | | 5/1968 | Burt | |
| 3,756,593 | A | * | 9/1973 | Lehr | 482/35 |
| 3,809,181 | A | | 5/1974 | Staranick et al. | |
| 3,817,351 | A | | 6/1974 | Mikkelson | |
| 3,907,064 | A | | 9/1975 | Svalberg et al. | |
| 3,910,383 | A | * | 10/1975 | Friedl | 198/321 |
| 4,079,811 | A | | 3/1978 | Driskell | |
| 4,164,991 | A | | 8/1979 | Marra | |
| 4,189,030 | A | | 2/1980 | Leslie et al. | |
| 4,240,520 | A | | 12/1980 | LaGrone et al. | |
| 4,243,121 | A | | 1/1981 | Kiss et al. | |
| 4,577,726 | A | | 3/1986 | Wheeler | |
| 4,595,075 | A | | 6/1986 | Rodrigue | |
| 4,613,013 | A | | 9/1986 | Watling | |
| 4,709,783 | A | | 12/1987 | Tomioka et al. | |
| 4,793,436 | A | | 12/1988 | Lew et al. | |
| 4,943,046 | A | | 7/1990 | Beltzig | |
| 5,020,633 | A | | 6/1991 | Rangel | |
| 5,177,926 | A | * | 1/1993 | Frankel | 52/655.1 |
| 5,467,841 | A | | 11/1995 | Krumal | |
| 5,499,692 | A | | 3/1996 | Brook | |
| 5,605,203 | A | | 2/1997 | Chang | |
| 5,628,380 | A | | 5/1997 | Matisi | |
| 5,645,139 | A | | 7/1997 | Liou | |
| 5,848,667 | A | | 12/1998 | Davidson | |
| 5,971,105 | A | | 10/1999 | Jacobson | |
| 6,012,549 | A | | 1/2000 | Adams | |
| 6,102,155 | A | | 8/2000 | Hood et al. | |
| 6,129,178 | A | | 10/2000 | Shupp, Jr. | |
| 6,357,551 | B1 | | 3/2002 | Bogardus, III | |
| 6,390,235 | B1 | | 5/2002 | Tsay | |
| 6,402,663 | B1 | * | 6/2002 | Popp | 482/35 |
| 6,550,580 | B1 | | 4/2003 | Roches | |
| 2004/0055824 | A1 | * | 3/2004 | Karnes et al. | 182/234 |

FOREIGN PATENT DOCUMENTS

| | | |
|---|---|---|
| GB | 2 222 848 | 3/1990 |

* cited by examiner

BUILDING ESCAPE SYSTEM

RELATED APPLICATIONS

This application is a continuation-in-part of U.S. application Ser. No. 11/207,445, filed on Aug. 19, 2005 (the contents of which are incorporated herein by reference); and this application is also a continuation of U.S. application Ser. No. 12/036,133, filed on Feb. 22, 2008 (the contents of which are incorporated herein by reference), which is based in part on U.S. Provisional Application No. 60/902,687, filed Feb. 22, 2007 (the contents of which are incorporated herein by reference).

FIELD OF THE INVENTION

The present invention relates to flexible ladders for emergency escape from buildings.

BACKGROUND OF THE INVENTION

A variety of flexible ladders and the like have long existed for use in various emergency situations, a prime example of which is use for escape from burning buildings. Among other things, the prior art includes a variety of rope ladders, ladders with rigid rungs connected by ropes or chains, flat bands intended for use in descending, and other structures which can be collapsible for storage purposes.

Many of the prior art devices have significant disadvantages and shortcomings and there is a need for innovation in the field. For some devices, collapsing for compact storage is problematic or has disadvantages. There may be difficulty in unfurling the structure for use in a time of emergency, with susceptibility to problems such as tangling. Certain prior disclosures of flat band devices have problematic slit-like features which can tend to pose difficulties for persons trying to lower themselves—problems related to difficulty in securing proper foot engagement with the device. Excessive flexibility is another problem, as is limited capability for dealing concurrently with multiple persons seeking to escape, e.g., from a burning building. Furthermore, it is noted that potential revisions of prior structures for the purpose of alleviating certain problems can introduce or exacerbate other problems.

An important issue for any escape ladder is its immediate availability in fully operative condition in case of emergencies, which may happen decades after installation. Such availability can be achieved by storing escape ladders immediately next to windows or on the roof of a building in such a way that, when needed, the ladder can be dropped down for evacuation. Certain collapsible ladders may tend not to withstand long-term outdoor storage because of being susceptible to rot, rust and other types of destruction. Prior art ladders may need to be covered by protective structure outside.

In summary, there is a need for an improved collapsible ladder that overcomes some of the problems and shortcomings of the prior art, and provides highly reliable fire-escape apparatus.

OBJECTS OF THE INVENTION

It is an object of the invention to provide an improved escape system for a building overcoming some of the problems and shortcomings of the prior art, including those referred to above.

Another object of the invention is to provide an escape system incorporating an endless ladder-like device which is sufficiently flexible to facilitate compact storage while being sufficiently fixed in its form to facilitate unfurling and stability of position during usage in an emergency.

Another object of the invention is to provide an escape system incorporating an endless ladder-like device having the advantages mentioned herein and at the same time allowing relatively effortless positioning by a person of his or her feet and hands thereon for secure descend.

Still another object of the invention is to provide an escape system incorporating an endless ladder-like device which can be readily stored outside for an extended period of time.

Yet another object of the invention is to provide an escape system incorporating an endless ladder-like device which has an improved speed control of a descent of such ladder-like device.

Another object of the invention is to provide an escape system incorporating an endless ladder-like device which has an automatic wind up feature.

How these and other objects are accomplished will become apparent from the following descriptions and the drawings.

SUMMARY OF THE INVENTION

The present invention provides an improved escape system for a building for secure relatively effortless descend of a person to safety.

The inventive escape system includes a belting ladder and a control apparatus. The belting ladder is formed by an endless band of a flat flexible reinforced belting material with a plurality of longitudinally-spaced apertures through the band along its length. Each aperture has a substantially transverse edge portion forming rung-like features along the band for human engagement such as to receive a person's foot or hand. The control apparatus including (a) a support structure mountable to the building, the support structure having a central shaft and a pulley member secured with respect to the central shaft and rotatable thereabout with the endless band around the pulley, and (b) a speed limiter mounted with respect to the main shaft for restraining rotation of the pulley member during human descent by belt movement. The control apparatus further preferably includes a winder device adjacent to the pulley member and having at least one rod engageable with the belting ladder and orbitable with an engaged portion thereof about the central shaft. Preferably, a motor operates the winder device to restore the system to its non-use condition.

The term "orbitable," as used with respect to the winder rod means that such winder rod can travel around the central shaft with the pulley member.

In the most highly preferred embodiments of this invention, the speed limiter includes a gear set having a speed-reducing ratio. Such ratio depends on the height of a building as well as anticipated load formed by people descending on the endless belting ladder. The gear may be pre-arranged to predetermine the highest speed for rotation of the cylindrical member so the endless belting ladder is adapted to travel without exceeding a given maximum speed irrespective of the number of people descending at the same time. In small-size escape systems for three- to four-story buildings such gear set is preferably positioned inside the pulley member such that the entire system is very compact for storage.

The belting ladder descends due to the weight of humans on the ladder, thereby providing continuous automatic movement. Because of the relatively steady structure of the belting material complemented by the design of the apertures forming rung-like features, the inventive escape system provides relatively effortless evacuation for people of average or low strength and without any special skills. A person can just grab on the closest part of the belting ladder, place his or her foot into the aperture which can be easily located, and remain in such position until reaching the height comfortable for jumping or stepping down on the ground or safe platform.

In certain preferred embodiments of the escape system the speed limiter of the control apparatus may further include a braking mechanism operatively connected to the rotatable pulley and a speed sensor set to actuate the braking mechanism when rotation of the rotatable pulley is in excess of a rate corresponding to a safe descent speed.

In some of such preferred embodiments the speed sensor is powered by a battery. Alternatively, the speed sensor may be powered by a generator driven by operation of the pulley system during human descent.

In some embodiments the braking mechanism is a disk-brake. However, the brake mechanism can be of a variety of types including hydraulic, compressed air-operated air brakes, drum brakes or windmill-type brakes. The braking mechanism can be controlled by signals from the sensor or a gear box containing the gear set based on a setting for desirable speeds.

In some preferred embodiments the speed limiter includes a governor. The term "governor," as used herein means a device for maintaining uniform speed regardless of additional load.

In some embodiments of the invention, for example, escape systems of a medium size, the control apparatus includes a fluid clutch operatively connected to the central shaft. Such fluid clutch may be positioned immediately adjacent to the gear set for operation with the gears. The fluid clutch may of a wide variety of available fluid clutches. The fluid clutch is operatively connected with respect to the rotatable pulley member to regulate the speed of rotation of the pulley and to slow it down when such rotation is in excess of a rate corresponding to a safe descent speed. In such embodiments there would be no need for a separate breaking mechanism or a speed sensor.

The speed limiter might be a completely mechanical device which actuates the braking mechanism by putting mechanical force on the brake. Alternatively, the speed limiter may be a mechanical, electronic or any other type of speed sensor actuating the brake mechanism.

In some alternative embodiments of the escape system the pulley system may further include at least one manual braking cord for slowing or stopping the descend of the endless belting ladder by pulling the cord.

In certain highly preferred embodiments the escape system includes a set of safety belts with hooks for securing persons to the ladder. The safety belts are stored within a fireproof box affixed to the support structure.

In some highly preferred embodiments of the escape system the control apparatus includes a pair of support plates secured with respect to the central bar one on each of opposite sides of the pulley member and rotatable with the pulley member. The winding device preferably has a pair of the rods extending between the first and second support plates and secured thereto such that two lengths of the endless band are between the rods. Some versions of such embodiments may include a third rod extending between the first and the second plate. The three rods are preferably positioned equidistant with respect to each other such that the rewound ladder forms a substantially round and symmetrical coil.

It is highly preferred that the control apparatus further includes a rewind pin extending through at least one of the plates and into the pulley member to fixedly interconnect the pulley and the plate such that the pulley rotates the plates with the rods about the central shaft with the rods engaging the lengths of the ladder for winding the ladder into a coil. A locking-release pin (sometimes referred to herein simply as a "release pin") extends through at least one of the plates into the pulley member to hold the coil in place for storage. For storage the rewind pin is removed to leave the plates in a fixed position while the pulley member is rotatable about the central shaft. For use the release pin is removed to unwind the ladder into its use position.

Highly preferred embodiments of the escape system further include a guard having an elongate band of the flat flexible reinforced belting material disposed inside the endless band of the belting ladder. The elongate band may be of reinforced belting material. Such elongate band creates a barrier between upwardly and downwardly moving lengths of the endless band during operation of the belting ladder. During evacuation, especially from very tall buildings or during windy weather, the two lengths of the ladder may become closely adjacent to each other. When this occurs, the apertures forming rung-like features may momentarily become sufficiently aligned to receive person's hand or foot through both lengths of the ladder, which may result in an injury. The inner guard band spreads the two lengths of the ladder and minimizes accessability of the aligned apertures.

In such highly preferred embodiments, the elongate band extends from an upper end to a lower end, the upper end being secured with respect to the support structure. The guard preferably further includes a hold-down weight secured to the lower end of the elongated band for stabilizing the ladder during use and rewinding.

The guard further includes a guard bracket which secures the weight to the lower end of the elongated band, a hold-down shaft secured to the guard bracket, and a landing bracket including walls positioned to receive the hold-down shaft therebetween to limit movement thereof during operation of the belting ladder within a position defined by the sidewalls. The walls of the landing bracket may be permanently installed in the ground or a safe landing platform. Alternatively, the landing bracket may be configured for removable secure engagement with a permanent structure at the ground level or on the landing platform.

Some embodiments of the inventive escape system further include a railing extending along at least a portion of a building perimeter, and a frame movably connected to the railing. The support structure is preferably secured with respect to the frame such that the belting ladder may be moved to a necessary position along the building for emergency evacuation. The railing may be in a form of an I-beam including rollers along its length. This provides great flexibility for use of the escape system which would allow a single ladder to serve a large portion of a building facade, such that in case of emergency the ladder may be moved to a necessary location via the railing.

In highly preferred embodiments of this invention, the support structure includes a frame having an overhead shaft, and a first and a second lower rods. In such embodiments the one cylindrical member is a head pulley rotatably secured with respect to the central bar. The pulley system also preferably includes an adjustable spring-tension-roller mounted on the overhead shaft. Furthermore, a first and a second adjustable belt-snubbers are respectively positioned on the first and the second lower rods.

In special highly preferred embodiments of the invention the belting ladder forms a coil for storing. The escape system further includes a tug-tab for releasing the belting ladder from a coiled orientation into an extended suspended orientation. In some cases, the fire-escape belting ladder may further include an alarm-actuated device for releasing the belting ladder. The ladder might be released by an actuation of the release pin operatively connected to the tag-tab or the alarm-actuated device.

In the inventive belting ladder, the preferred belting material of the elongated band is conveyer belting—i.e., material of the type used for conveyor belts. The term "conveyer belting" as used herein refers to tough flat polymeric materials such as KEVLAR®, rubber, nylon, PVC or other strong yet flexible material which is flexible in the sense and to the extent that it can be rolled up into a coil but still retains sufficient form when a user's weight is applied at an aperture therein. Such conveyor belting typically includes flexible elongate reinforcement elements therein which extend through, are surrounded by, and adhere to the flat polymeric belting material. The elongate reinforcement may be made of metal, polymer, fiber, vegetable textile threads or other suitable materials used for manufacturing conveyer belting.

There is a wide variety of conveyor belting material which is suitable for the present invention and the above definition is in no way limiting for a special type of belting material. Moreover, new, used or scrap conveyer belting can also be used for the present invention.

In certain preferred embodiments the apertures have substantially round shapes with preferred diameter of approximately six inches.

In some preferred embodiments the transverse edge portions are substantially straight horizontal edges with the belting ladder being vertically oriented. In some of such embodiments, the apertures have substantially rectangular shapes preferably having width and height of approximately six inches.

The term "operatively connected" as used herein includes but does not require direct connection. For example, the phrase "operatively connected to the rotatable pulley," in describing the braking mechanism includes engagement by the braking mechanism with a rotating member other than the rotatable pulley itself as long as such rotating member and rotatable pulley have a geared connection of some sort.

It should be understood that there may be different assemblies of the ladder with the control apparatus. For example, in a small ladders used for fire-escape from buildings not acceding five stories the control apparatus may be of a sufficiently small size for its positioning inside the head pulley.

DETAILED DESCRIPTION OF PREFERRED EMBODIMENTS

Figure 1:
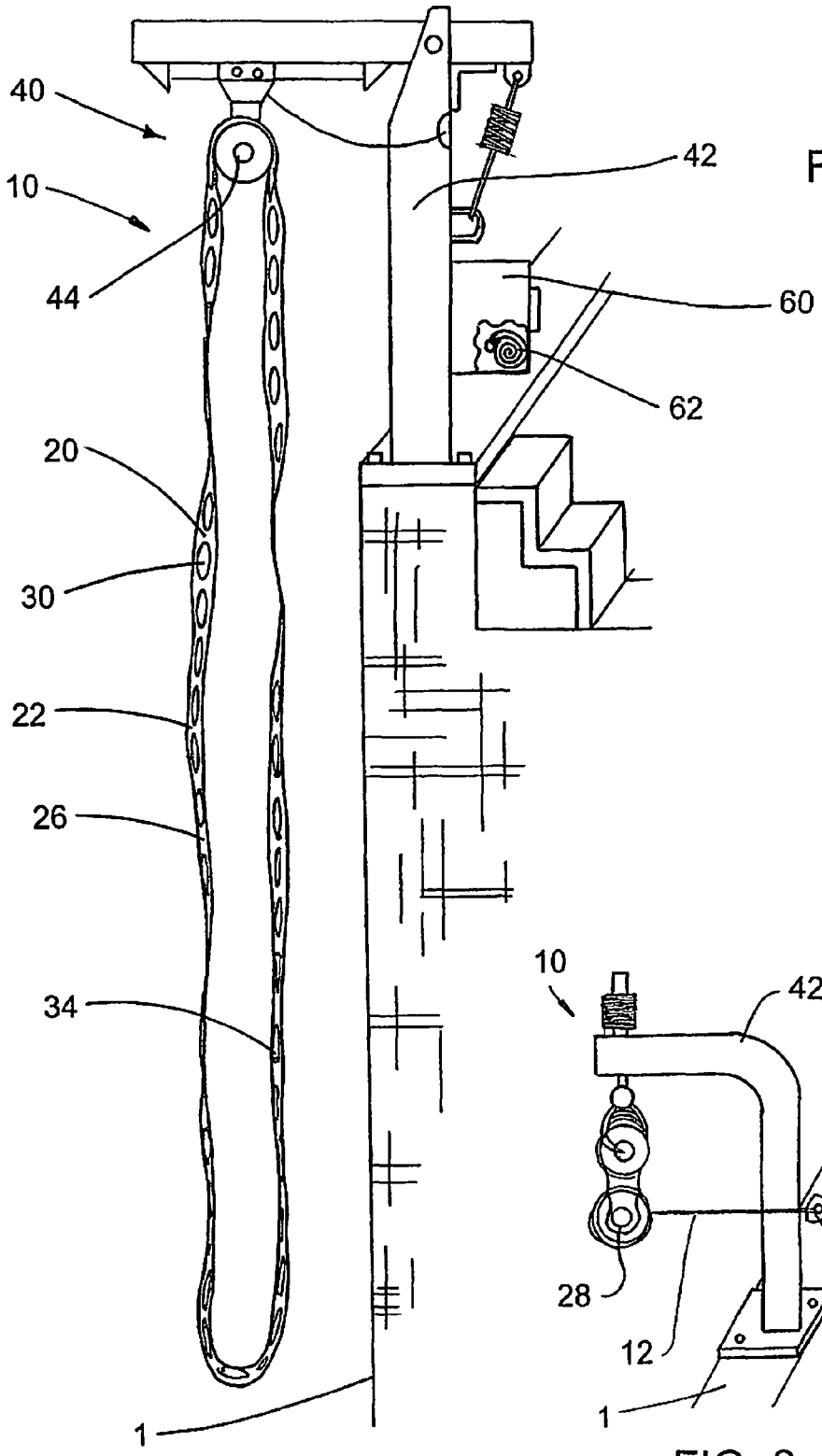
FIG. 1 is an isometric view of an escape system for a building showing the endless belting ladder in suspended orientation.

FIGS. 1-12 illustrate an inventive escape system 10 for a building 1. Referring to the figures, inventive escape system 10 includes an endless belting ladder 20 formed by an endless elongated band 22 with a width 24 of a flat flexible reinforced belting material 26 having a plurality of longitudinally-spaced apertures 30 each with a substantially transverse edge portion 32 thereby forming rung-like features 34 along belting material 26 to receive a person's foot or hand; and a control apparatus 40 (for convenience also referred to as a pulley system 40) having a support structure 42 mountable to building 1, at least one substantially cylindrical member 44 rotatably secured with respect to support structure 42, and a speed limiter 46 controlling the rotation of cylindrical member 44. Endless band 22 is secured around cylindrical member 44.

Figure 4:
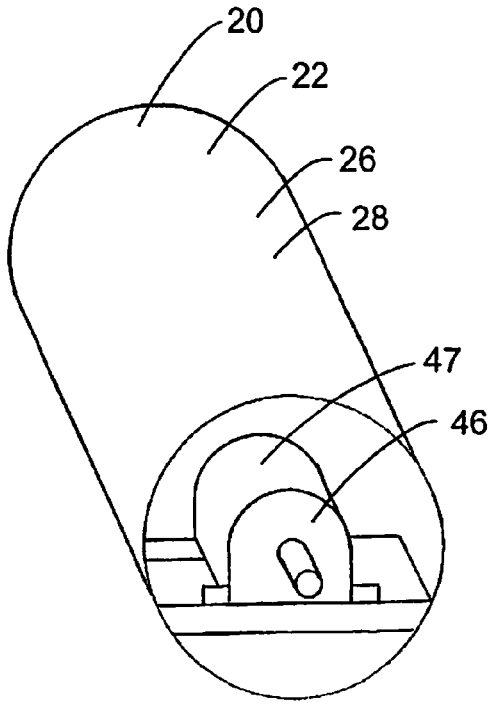
FIG. 4 is an isometric view of the belting ladder in coiled orientation showing one example of the speed reducer.

As seen on FIG. 4 speed reducer 46 is a gear box 47 set for a maximum speed controlling descending movement of belting ladder 20.

Figure 5:
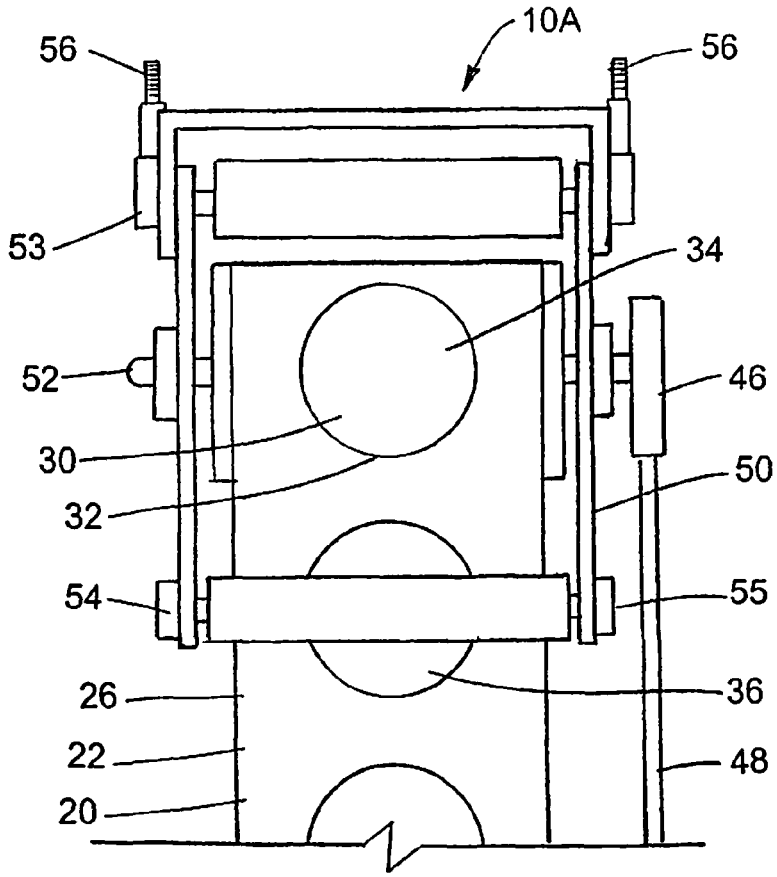
FIG. 5 is a front view showing a portion of a small-size escape system immediately around the head pulley.

FIG. 5 shows an optional hand brake in form of a braking cord 48 for slowing or stopping the descend of endless belting ladder 20 by pulling cord 48.

Figure 3:
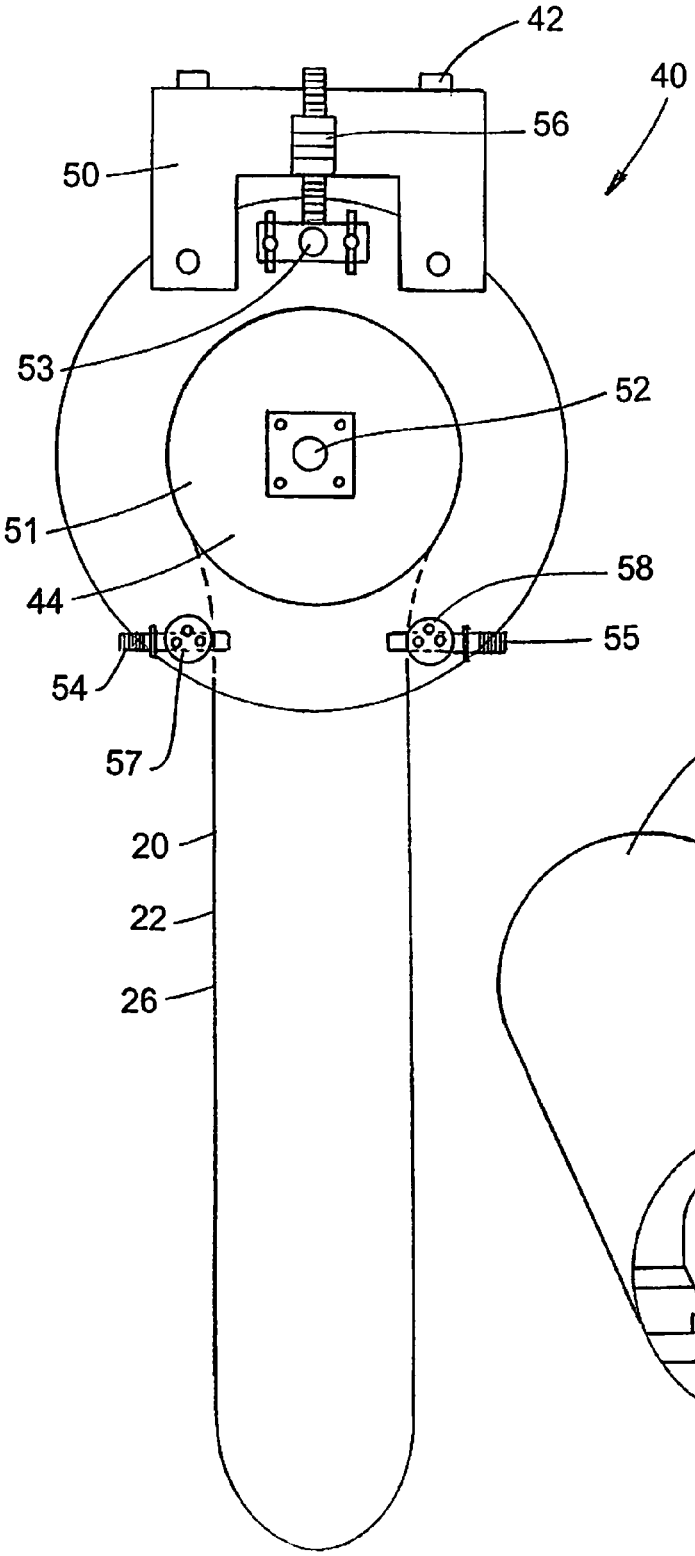
FIG. 3 is a side elevation of the escape system showing the endless belting ladder in suspended orientation.

FIGS. 3 and 5 illustrate support structure 42 including a frame 50 having a central shaft 52, an overhead shaft 53, and a first and a second lower rods 54 and 55, respectively. Cylindrical member 44 is a pulley member 51 rotatably secured with respect to central shaft 52. As seen on FIG. 3 pulley system 40 also includes an adjustable spring-tension-roller 56 mounted on overhead shaft 53. Furthermore, a first adjustable belt-snubber 57 and a second adjustable belt-snubber 58 are respectively positioned on first and second lower rods 54 and 55.

FIG. 1 further shows a fireproof box 60 affixed to the support structure 42 A set of safety belts 62 with hooks for securing persons to ladder 20 are stored within fireproof box 60. For illustrative purposes only, box 60 is shown with cut-away wall to open view to belts 62.

Figure 2:
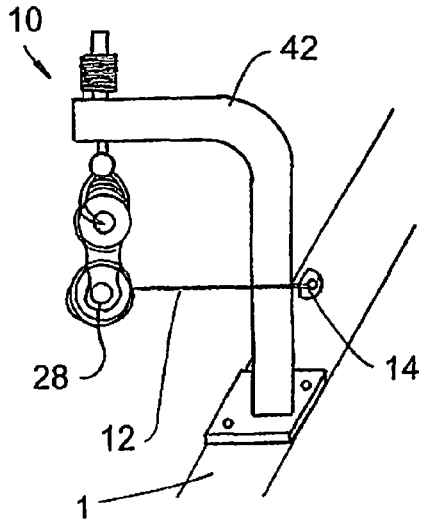
FIG. 2 is an isometric view of the escape system for a building showing the endless belting ladder in coiled orientation.

As seen on FIGS. 2 and 4 belting ladder 20 forms a coil 28 for storing. Escape system 10 may further include a tug-tab 12 for releasing belting ladder 20 from a coiled orientation into an extended suspended orientation. In some cases, fire-escape belting ladder 20 may further include an alarm-actuated device 14 for releasing belting ladder 20.

Figure 6:
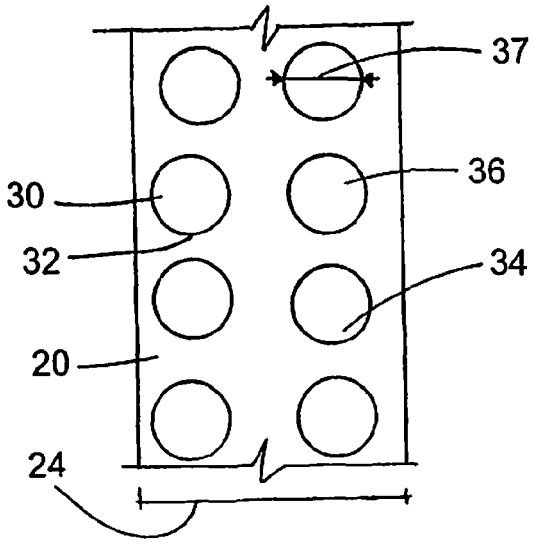
FIG. 6 is a front elevation of the belting ladder having an alternative arrangement of the apertures.

FIGS. 5 and 6 show apertures 30 having substantially round shapes 36 with preferred diameter 37 of approximately six inches.

Figure 7:
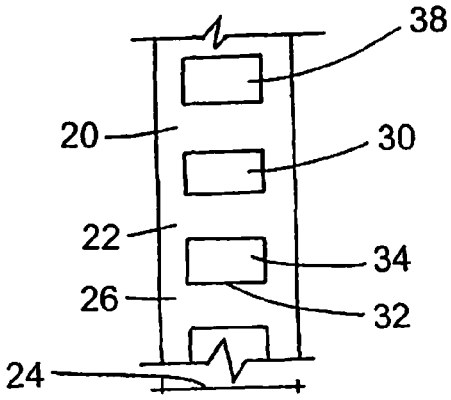
FIG. 7 is a front elevation of the belting ladder showing apertures having substantially rectangular shapes.

FIG. 7 shows one of the preferred embodiments having transverse edge portions 32 being substantially straight horizontal with belting ladder 20 being vertically oriented. Apertures 30 on FIG. 7 have substantially rectangular shapes 38 which are approximately six inches wide and approximately six inches high.

Width 24 of band 22 may be approximately ten inches, as shown on FIGS. 1, 5 and 7. Alternatively, if conditions require a bigger ladder to accommodate a larger number of people using the ladder simultaneously, width 24 of belting ladder 20 can be approximately twenty inches or wider and have therefore more longitudinally-spaced apertures 30. An example of such alternative ladder 20 is shown on FIG. 6.

FIGS. 8-11 show inventive escape system 10, including belting ladder 20 formed by endless band 22 having a plurality of longitudinally-spaced apertures 30 forming rung-like features 34 therealong for human engagement, and control apparatus 40. Control apparatus 40 includes support structure 42 mountable to building 1, speed limiter 46, a winder device 80, and a motor 16 that operates winder device 80 to restore system 10 to its non-use condition. Winding device 80 also includes a DC clutch 84 operatively connected to motor 16 and speed limiter 70. Support structure 40 has central shaft 52 and pulley member 51 secured with respect to central shaft 52 and rotatable thereabout with endless band 22 around pulley 51. Speed limiter 70 is mounted with respect to main central shaft 52 for restraining rotation of pulley member 51 during human descent by belt movement. Winder device 80 is positioned adjacent to pulley member 51 and has at least one rod 54 engageable with band 22 and orbitable with an engaged portion thereof about central shaft 52.

FIG. 5 shows a small-size escape system 10A for fire-escape from buildings not acceding five stories. In the escape system 10A the speed limiter includes a gear set having a speed-reducing ratio. In such small-size system, the control apparatus is of a sufficiently small size and is positioned inside pulley member 51.

Figure 8:
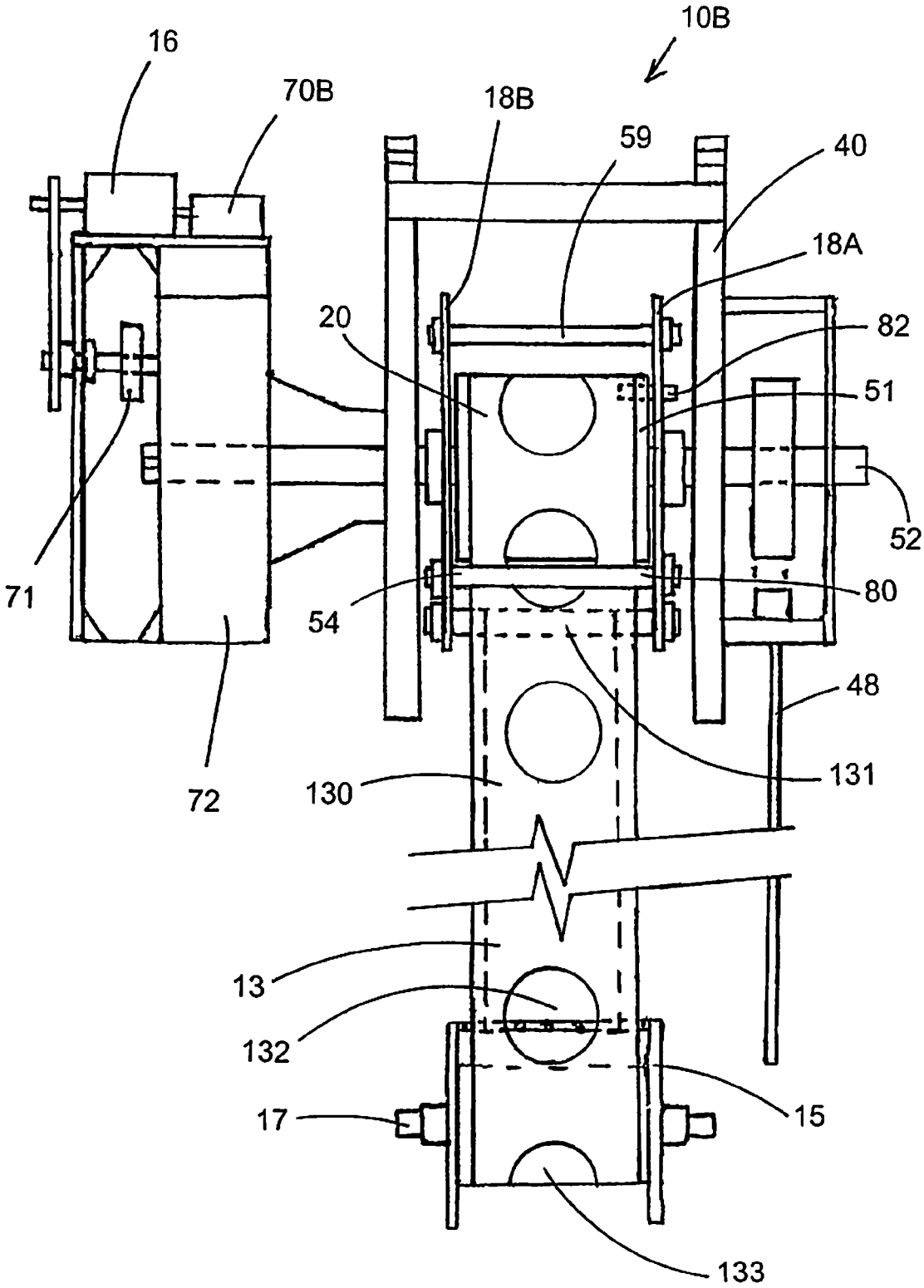
FIG. 8 is a front view of a medium-size escape system showing the endless belting ladder in suspended orientation.
Figure 9:
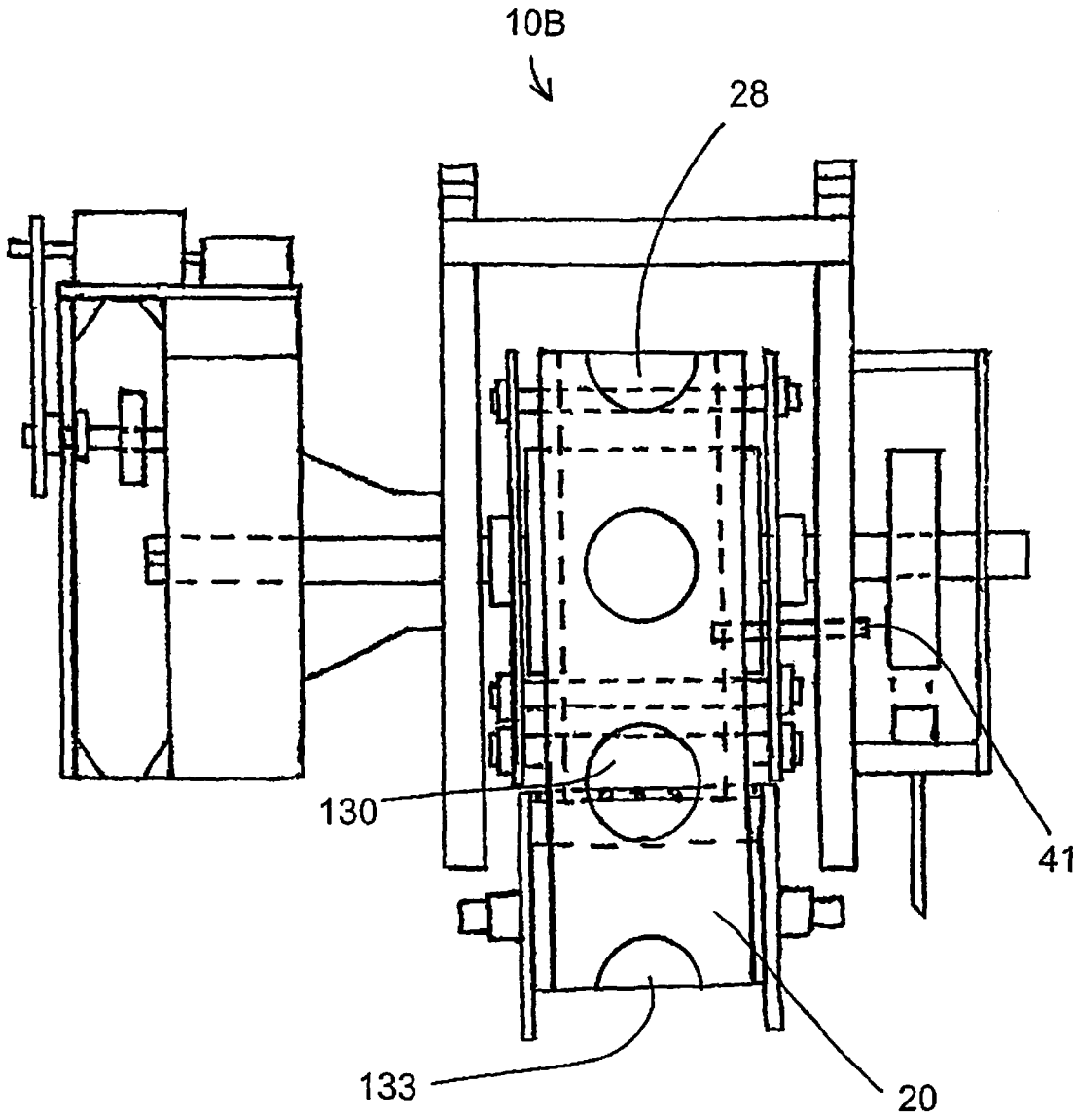
FIG. 9 is a front view of the system of FIG. 8 but showing the endless belting ladder in its coiled, non-use orientation.

FIGS. 8 and 9 illustrate a medium-size escape system 10B which has a speed limiter 70B. Speed limiter 70B includes a fluid clutch 71 which is operatively connected to central shaft 52.

Figure 10:
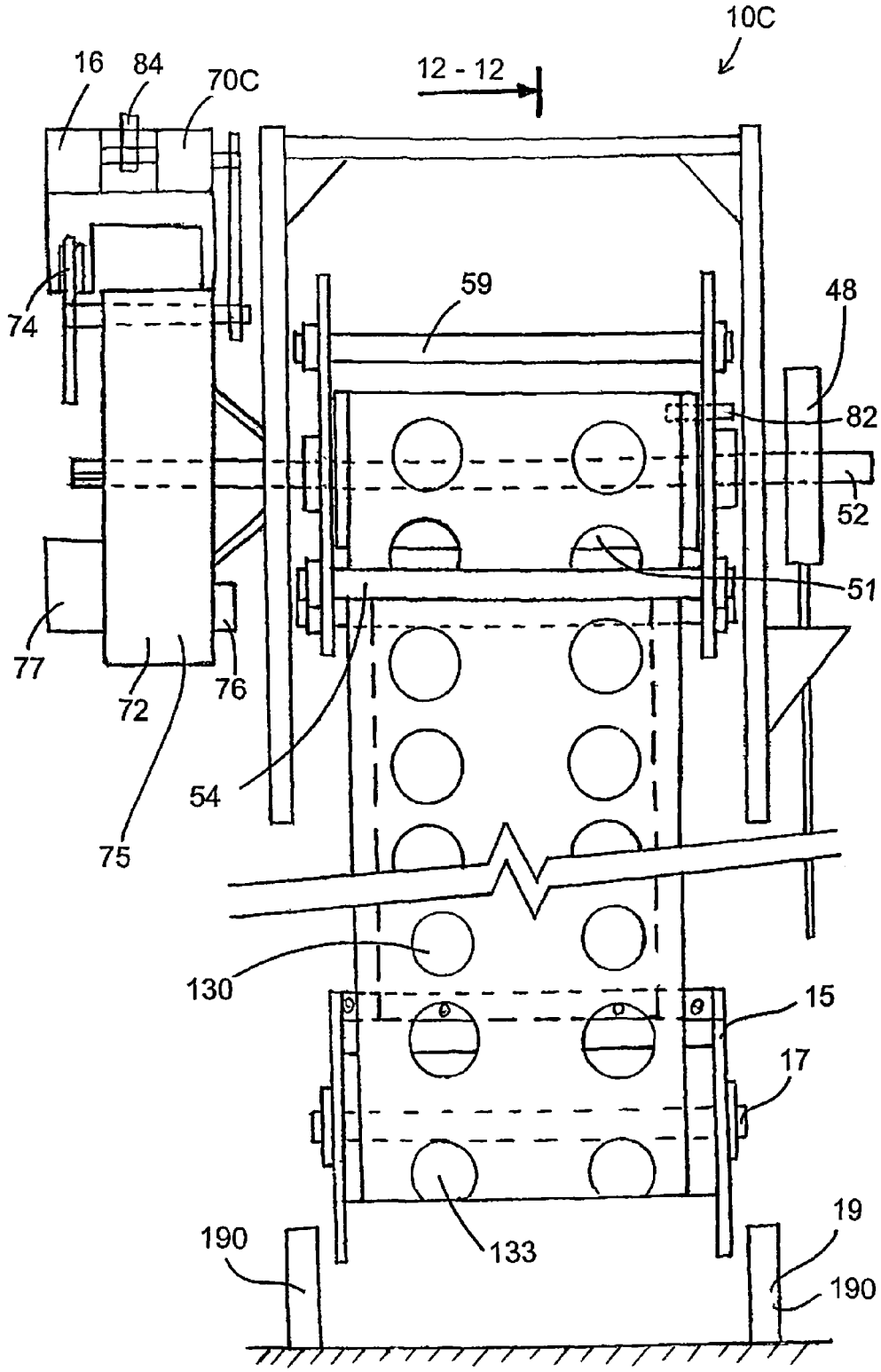
FIG. 10 is a front view of a large-size escape system showing the endless belting ladder in suspended orientation.
Figure 11:
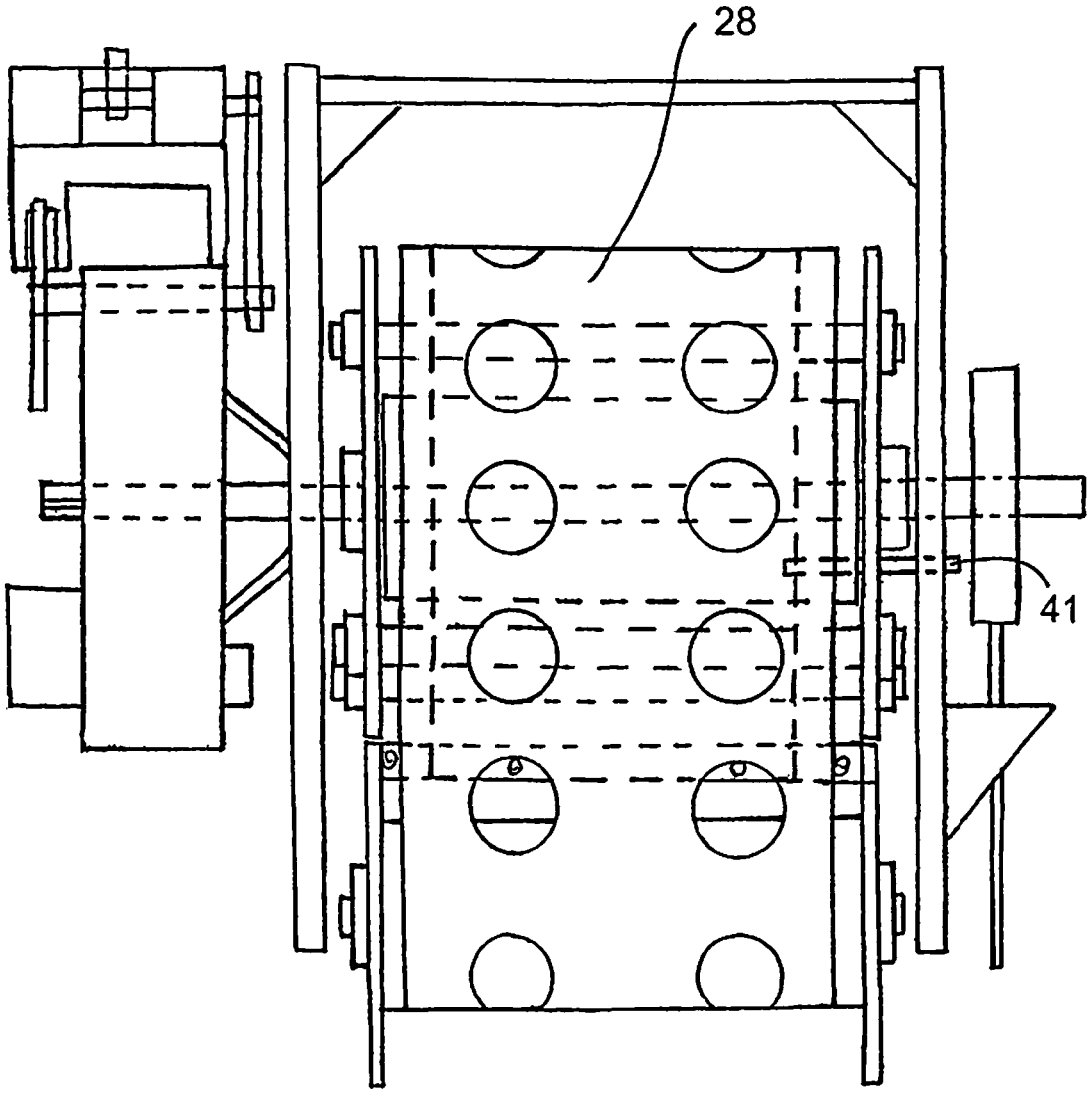
FIG. 11 is a front view of the system of FIG. 10 but showing the endless belting ladder in its coiled, non-use orientation.

FIGS. 10 and 11 illustrate a large-size escape system 10C for high-rise buildings. Escape system 10C has a speed limiter 70C with a braking mechanism 74 which is a disk-brake operatively connected to the rotatable pulley. A speed sensor 76 is set to actuate the braking mechanism when rotation of the rotatable pulley is in excess of a rate corresponding to a safe descent speed. In some preferred embodiments the speed limiter includes a governor 75. The speed sensor may be powered by a battery. FIG. 10 illustrates a generator 77 driven by operation of the pulley system during human descent.

Figure 12:
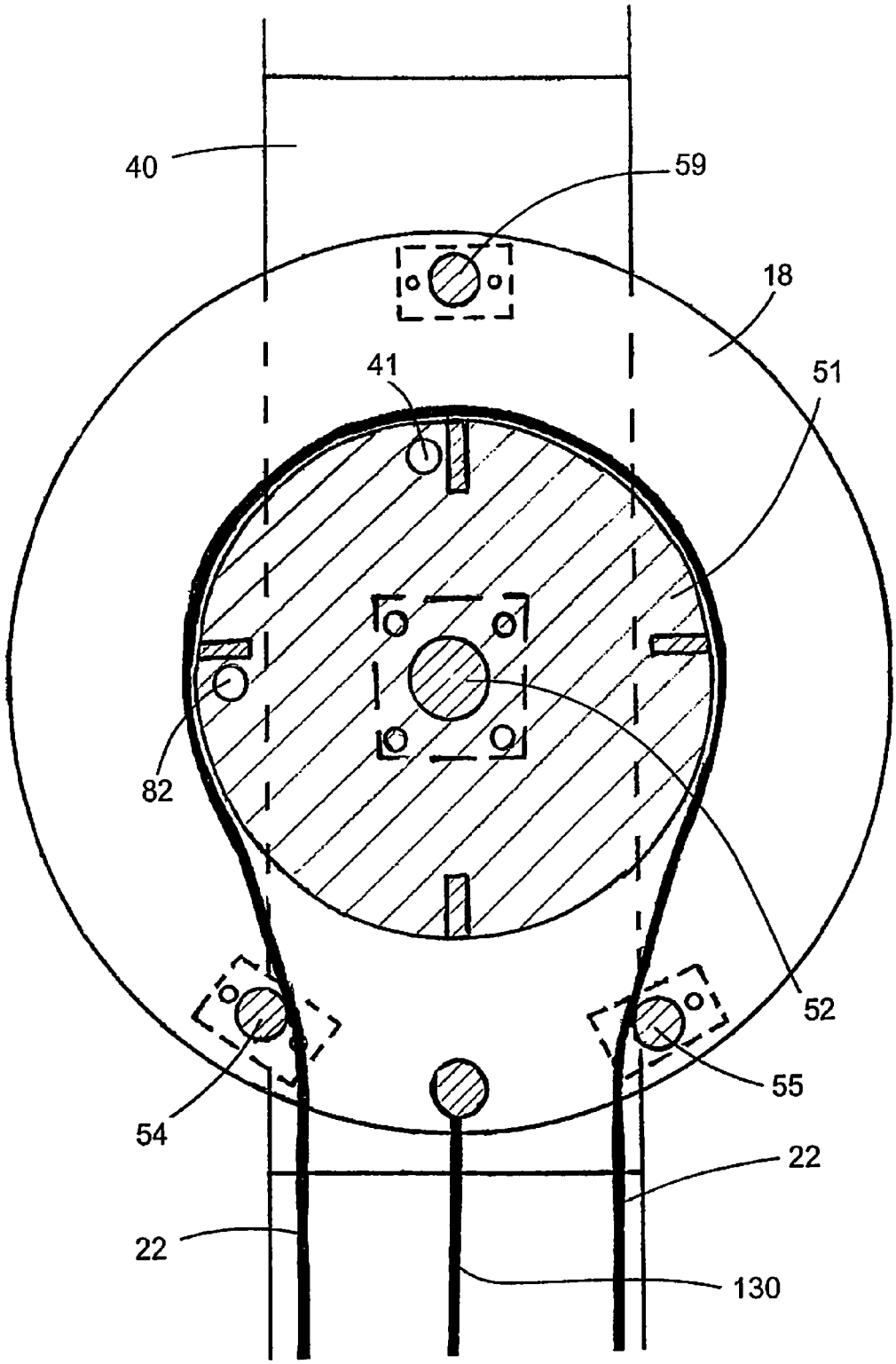
FIG. 12 is a sectional view of the device of FIG. 10 taken along section lines 12-12 as indicated in FIG. 10.

Control apparatus 40 further includes a pair of support plates 18A and 18B secured with respect to central shaft 52 on opposite sides of pulley member 51. As best seen in FIG. 12, winding device 80 preferably has a pair of rods 54 and 56 extending between 18A and 18B plates and secured thereto such that two lengths of endless band 22 are between the rods. Winding device 80 also includes a third rod 59 extending between the first and the second plate above pulley member 51. The three rods are so positioned with respect to each other such that rewound ladder, as illustrated in FIGS. 9 and 11, forms a substantially round and symmetrical coil 28.

FIGS. 8 and 10 show that winding device 80 further includes a rewind pin 82 extending through plate 18A into pulley member 51 and fixedly interconnecting pulley 51 and the plates. With this interconnection, pulley 51 rotates the plates (with rods 54 and 55) about central shaft 52 with rods 54 and 55 engaging the lengths of ladder 20 for winding ladder 20 into coil 28. When rewind pin 82 is removed, plates 18A and B remain in stationary position while pulley member 51 is rotatable about central shaft 52.

FIGS. 9 and 11 show that control apparatus 40 includes a locking-release pin 41 extending through at least one of plates 18A and 18B into pulley member 51. Locking-release pin 41 preferably supports structure 42 to hold coil 28 in place for storage. For use the release pin is removed to unwind the ladder into its use position.

FIGS. 8-12 illustrate highly preferred embodiments of escape system 10 which further include a guard 13 having an elongate band 130 of flat flexible reinforced belting material 26 disposed inside endless band 22 of belting ladder 20, as best seen in FIG. 12. Such elongate band 130 creates a barrier between upwardly and downwardly moving lengths of endless band 22 during operation of belting ladder 20.

Elongate band 130 extends from an upper end 131 to a lower end 132. Upper end 131 is secured with respect to control apparatus 40 just below pulley member 51. FIGS. 8-11 further show that guard 130 also includes a hold-down weight 133 secured to the lower end 132 of elongated band 130 for stabilizing ladder 20 during use and rewinding. This enables gravity to assure a proper orientation of the belting ladder during usage.

FIG. 10 shows that guard 13 also includes a guard bracket 15 which secures weight 133 to lower end 132 of elongate band 130, a hold-down shaft 17 secured to guard bracket 15, and a landing bracket 19. Landing bracket 19 has walls 190 positioned to receive guard bracket 15 with weight 133 therebetween, thereby to limit its movement to a position defined by sidewalls 190, during operation of belting ladder 20. Landing bracket 19 may be permanently or removably installed in the desired position for the lower end of the belting ladder.

It should be understood that there may be different assemblies of the ladder with the control apparatus.

While the principles of the invention have been shown and described in connection with specific embodiments, it is to be understood that such embodiments are by way of example and are not limiting.

The invention claimed is:

1. An escape system for a building comprising:

a belting ladder formed by an endless band of a flat flexible reinforced belting material with a plurality of longitudinally-spaced apertures each with a substantially transverse edge portion forming rung-like features therealong for human engagement, the belting ladder being secured with respect to a support structure mountable to the building; and a guard including an elongate band of a flat flexible material disposed inside the endless band of the belting ladder, the elongate band creating a barrier between upwardly and downwardly moving lengths of the endless band during operation of the belting ladder, the guard elongate band extending from an upper end to a lower end, the upper end being secured with respect to the support structure, the guard including a hold-down weight secured to the lower end of the elongated band for stabilizing the ladder during use and rewinding.

2. The escape system of claim 1 wherein the guard further includes:

a guard bracket securing the weight to the lower end of the elongated band;

a hold-down shaft secured to the guard bracket; and a landing-bracket for positioning to receive the guard bracket to limit movement thereof during operation of the belting ladder.

3. The escape system of claim 1 further comprising control apparatus including:

a support structure mountable to the building, the support structure having a central shaft and a pulley member secured thereto and rotatable thereabout with the endless band around the pulley member; and a speed limiter mounted with respect to the central shaft for restraining rotation of the pulley member during human descent by belt movement.

4. The escape system of claim 3 wherein the control apparatus further includes a winder device adjacent to the pulley member and having a rod engageable with the ladder and orbitable therewith about the central shaft.

5. The escape system of claim 4 wherein the winder device includes a motor to wind the system to its non-use condition.

6. The escape system of claim 1 wherein the belting material is conveyor belting.

7. The escape system of claim 1 wherein the transverse edge portions are substantially horizontal when the belting ladder is vertically oriented.

8. The escape system of claim 4 wherein the control apparatus includes a pair of support plates secured with respect to the central shaft, one on each of opposite sides of the pulley member and rotatable therewith.

9. The escape system of claim 8 wherein the winder device has a pair of the rods extending between the support plates and secured thereto such that two lengths of the endless band are between the rods.

10. The escape system of claim 1 wherein the elongate band is of reinforced belting material.

11. An escape system for a building comprising:

a belting ladder formed by an endless band of a flat flexible reinforced polymeric belting material with a plurality of longitudinally-spaced apertures through the band along its length each aperture with a substantially transverse edge portion forming rung-like features therealong for human engagement, and control apparatus including:

a support structure mountable to the building, the support structure having a central shaft and a pulley member secured thereto and rotatable thereabout with the endless band around the pulley member;

a speed limiter mounted with respect to the central shaft for restraining rotation of the pulley member during human descent by belt movement;

a pair of support plates secured with respect to the central shaft, one on each of opposite sides of the pulley member and rotatable therewith;

a winder device adjacent to the pulley member and having at least one rod engageable with the ladder and orbitable therewith about the central shaft;

a rewind pin extending through at least one of the plates into the pulley member to rotationally interconnect such plate and the pulley so that rotation of the pulley rotates the plates with the rod about the central shaft for winding of the ladder into a coil; and a locking-release pin extending through at least one of the plates into the pulley member to hold the coil in place for storage, whereby for storage the rewind pin is removed to leave the plates in a storage position with the pulley being rotatable for use upon removal of the locking-release pin to allow the unwinding of the ladder into its use position.

12. The escape system of claim 11 wherein the speed limiter includes a gear set having a speed-reducing ratio.

13. The escape system of claim 11 wherein the speed limiter includes a fluid clutch operatively connected with respect to the rotatable pulley member so as to slow down rotation of the pulley when such rotation is in excess of a rate corresponding to a safe descent speed.

14. The escape system of claim 11 wherein the speed limiter includes:

a braking mechanism operatively connected to the rotatable pulley; and a speed sensor set to actuate the braking mechanism when rotation of the rotatable pulley is in excess of a rate corresponding to a safe descent speed.

15. The escape system of claim 14 wherein the speed sensor is powered by a generator driven by operation of the pulley system during human descent.

16. The escape system of claim 11 wherein the speed limiter includes a governor.

17. The escape system of claim 11 wherein the belting material is conveyor belting.

* * * * *